US007651444B2

(12) United States Patent
Lai

(10) Patent No.: US 7,651,444 B2
(45) Date of Patent: Jan. 26, 2010

(54) AUXILIARY STRUCTURE FOR FITNESS EQUIPMENT EFFICACY

(76) Inventor: Ying-Chou Lai, No.365, Sec. 1, Jhongshan Rd., Huatan Township, Changhua County 503 (TW)

( * ) Notice: Subject to any disclaimer, the term of this patent is extended or adjusted under 35 U.S.C. 154(b) by 0 days.

(21) Appl. No.: 11/980,768

(22) Filed: Oct. 31, 2007

(65) Prior Publication Data

US 2009/0011910 A1 Jan. 8, 2009

(30) Foreign Application Priority Data

Jul. 6, 2007 (TW) ..... 96120527 A

(51) Int. Cl.
*A63B 22/04* (2006.01)

(52) U.S. Cl. ..... 482/52; 482/57; 482/62

(58) Field of Classification Search ..... 482/52, 482/57, 62

See application file for complete search history.

(56) References Cited

U.S. PATENT DOCUMENTS

| | | | | |
|---|---|---|---|---|
| 6,196,948 | B1 * | 3/2001 | Stearns et al. | 482/52 |
| 6,450,925 | B1 * | 9/2002 | Kuo | 482/52 |
| 6,719,666 | B1 * | 4/2004 | Lo et al. | 482/52 |
| 6,994,656 | B2 * | 2/2006 | Liao et al. | 482/52 |
| 7,097,591 | B2 * | 8/2006 | Moon | 482/52 |
| 7,201,706 | B1 * | 4/2007 | Lee et al. | 482/52 |
| 7,377,881 | B2 * | 5/2008 | Moon | 482/52 |
| 7,435,202 | B2 * | 10/2008 | Daly et al. | 482/52 |
| 2007/0032348 | A1 * | 2/2007 | Hong | 482/52 |
| 2007/0087903 | A1 * | 4/2007 | Lee et al. | 482/52 |
| 2007/0238582 | A1 * | 10/2007 | Lee | 482/52 |

* cited by examiner

*Primary Examiner*—Fenn C Mathew
*Assistant Examiner*—Andrew M Tecco
(74) *Attorney, Agent, or Firm*—Jackson IPG PLLC

(57) ABSTRACT

An auxiliary structure to improve efficacy of a fitness equipment includes a pair of swing bars pivoted to a pair of traction bars wherein in turn pivoted to a crank; the crank drives a sprocket and a resistance control wheel for both swing bars to drive both traction bars to travel up, down, back and forth; each pedal is disposed with a roller to travel in a slide attached to the traction bar and is pivoted to a pull-and-push connection bar, which in turn is pivoted to a transmission connection bar; each transmission connection bar is pivoted to a support; each mid section of the transmission connection bar is pivoted to an active connection bar, which in turn is pivoted to the swing bar; and each pedal is dragged by the push-and-pull connection bar driven by the transmission connection bar when both swing bars alternatively swing to drive the transmission connecting bar to increase longitudinal travel ranges of both pedals for providing adequate exercise amount for waist and legs of a user to improve exercise efficacy.

7 Claims, 10 Drawing Sheets

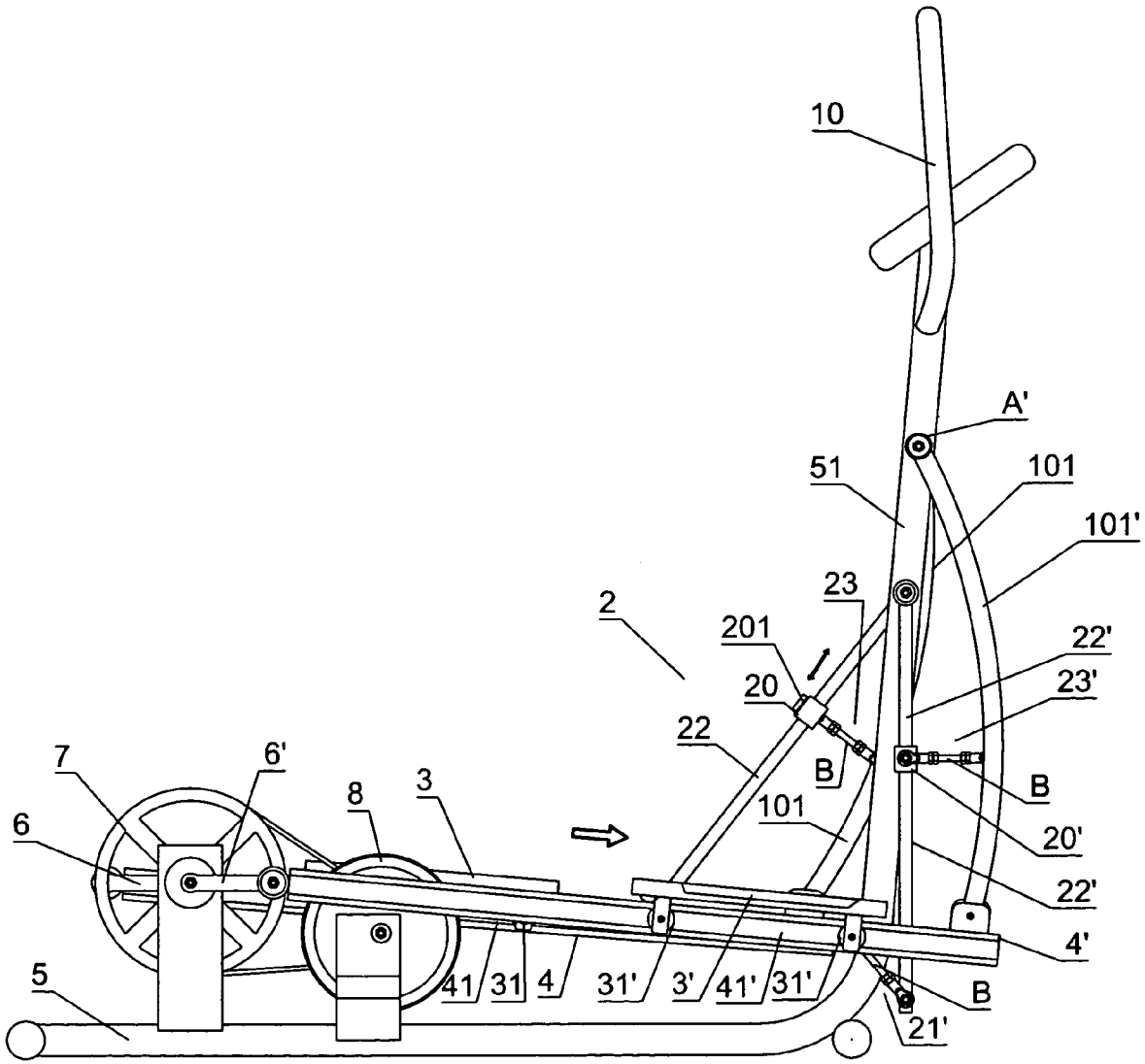
Fig. 5-A

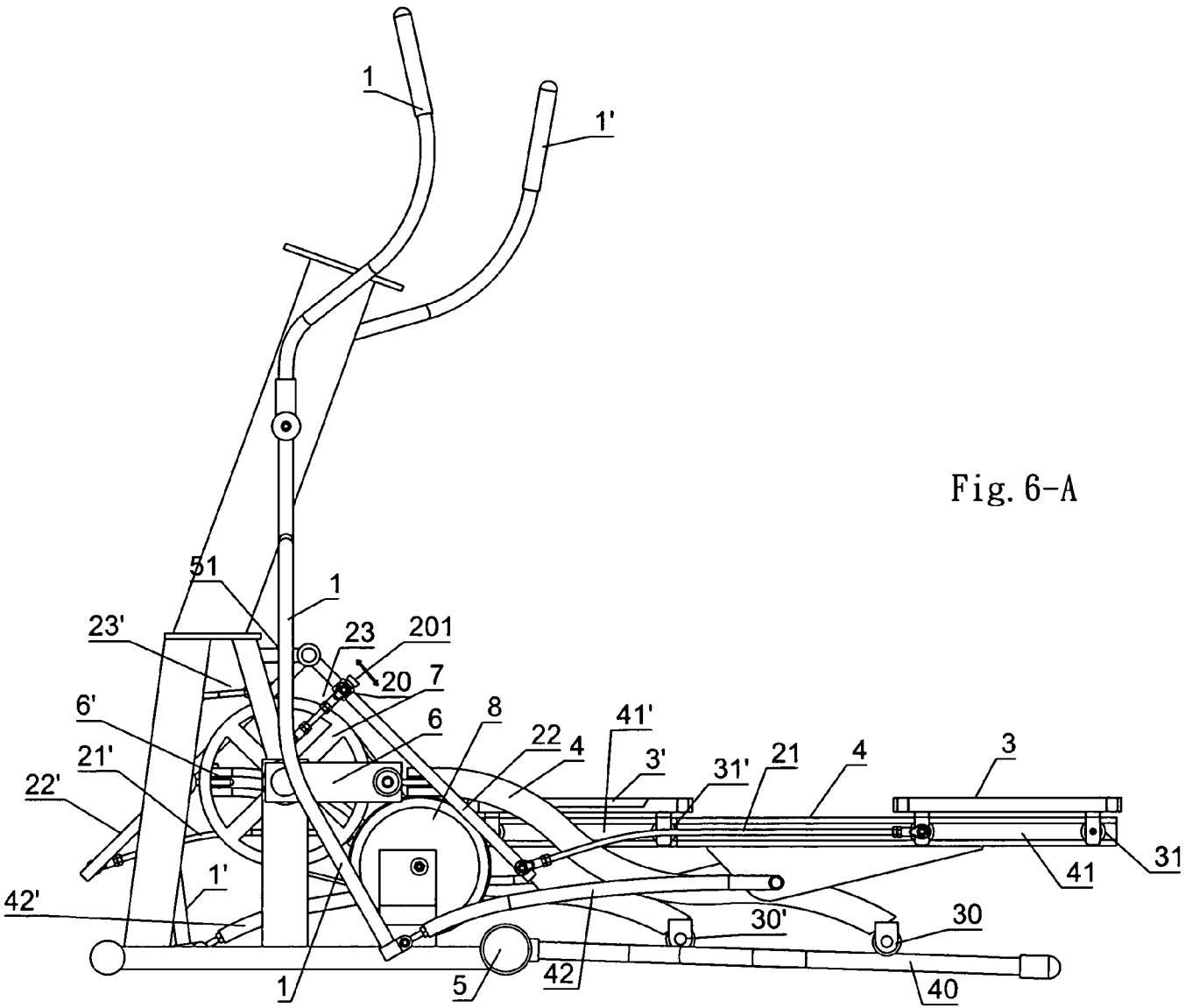
Fig. 6-A

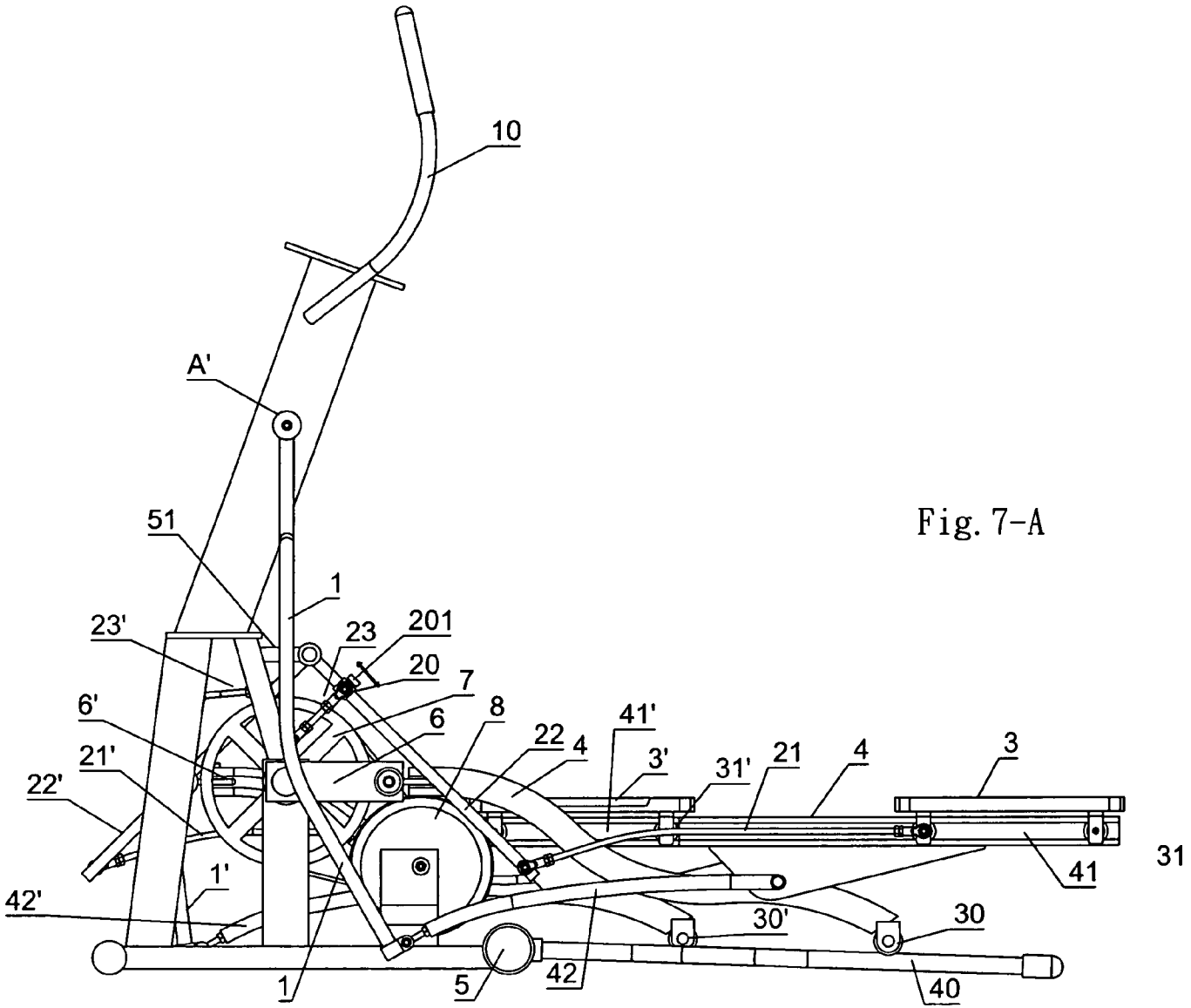
Fig. 7-A

AUXILIARY STRUCTURE FOR FITNESS EQUIPMENT EFFICACY

BACKGROUND OF THE INVENTION (a) Field of the Invention

The present invention is related to an auxiliary structure for efficacy of fitness equipment, and more particularly, to one that improves exercise efficacy by increasing longitudinal travel of a pair of pedals to put more exercise amount on one's legs and waist when a user alternatively swings a pair of swing bars to transmit kinetic energy through a connection bar of the fitness equipment to drives the pair of pedals to increase their longitudinal displacement.

(b) Description of the Prior Art

Steppers generally available in the market operate on having a swing bar to drive a traction bar; the traction bar relying upon a sprocket as an axis has its crank pivoted to the axis to revolve and drive the traction bar to ascend, descend, and travel back and forth; and a pair of pedals are fixed to the traction bar; and the amount of travel is simply determined by a revolving displacement of a length of the crank to achieve fitness purpose by treading on the pair of pedals.

However, in the stepper of the prior art, both pedals are fixed to the traction bar to limit striding distance thus to fail expected treading and twisting results.

Furthermore, the exercise results are very limited since the stepper of the prior art is at its best a strolling machine by allowing its user only to travel back and forth within a range as determined by the swing arc of the pair of the swing bar, and tread also in a very small range defined by the ascending and descending of the crank.

SUMMARY OF THE INVENTION

The primary purpose of the present invention is to provide an auxiliary structure to a fitness equipment to increase exercise efficacy by putting more exercise amount to one's waist and legs. To achieve the purpose, the present invention is applied to a pair of swing bars to drive a left set and a right set of connection bars so to indirectly transmit kinetic energy to a pair of pedals for both pedals to respectively increase longitudinal travel range on a pair of slides of both traction bars.

In the present invention, both swing bars are respectively pivoted to both sides of a support disposed at front of a base; both traction bars are respectively pivoted to lower ends of both swing bars; and both traction bars in turn are respectively pivoted to a crank; and the crank transmits kinetic energy to turn a sprocket to further drive a resistance control wheel for both swing bars alternatively swinging to respectively drive both traction bars to travel up, down, back, and forth. Two slides are respectively disposed to both traction bars for two rollers respectively disposed to both pedals to travel back and forth; both pedals are respectively pivoted to two push-and-pull connection bars; both push-and-pull connection bars are respectively pivoted to two transmission connection bars; both transmission connection bars are respectively pivoted to the support; and at where appropriately on a mid section of each of both transmission connection bars are respectively pivoted to two active connection bars; and both active connection bars are respectively pivoted to where appropriately on both swing bars. Accordingly, as both swing bars alternatively swing, the active connection bar drives the transmission connection bar to drag the push-and-pull bar; longitudinal travel range of each pedal for being dragged by the push-and-pull connection bar is increased to provide adequate exercise amount for the user's waist and legs for improving exercise efficacy.

The longitudinal travel range of the pedal dragged by the push-and-pull bar, which is driven by the transmission connection bar, can be changed by adjusting upper and lower positions where the active connection bar is pivoted to the transmission connection bar to meet of twist and treading demands of the user.

In the present invention, all pivoting elements applied for swing bar, active bar, transmission bar, and push-and-pull connection bar are related to sleeves or universal joints.

BRIEF DESCRIPTION OF THE DRAWINGS

FIG. 1-A is a perspective view showing both active connection bars and both push-and-pull bars in a first preferred embodiment of the present invention.

FIG. 2-A is a schematic view showing a magnified construction of connection bars in the first preferred embodiment of the present invention.

FIG. 5-A is a side view showing another operating status of the first preferred embodiment of the present invention.

FIG. 6-A is a side view of the second preferred embodiment of the present invention.

FIG. 7-A is a side view showing another operating status of the second preferred embodiment of the present invention.

DETAILED DESCRIPTION OF THE PREFERRED EMBODIMENTS

Figure 1:
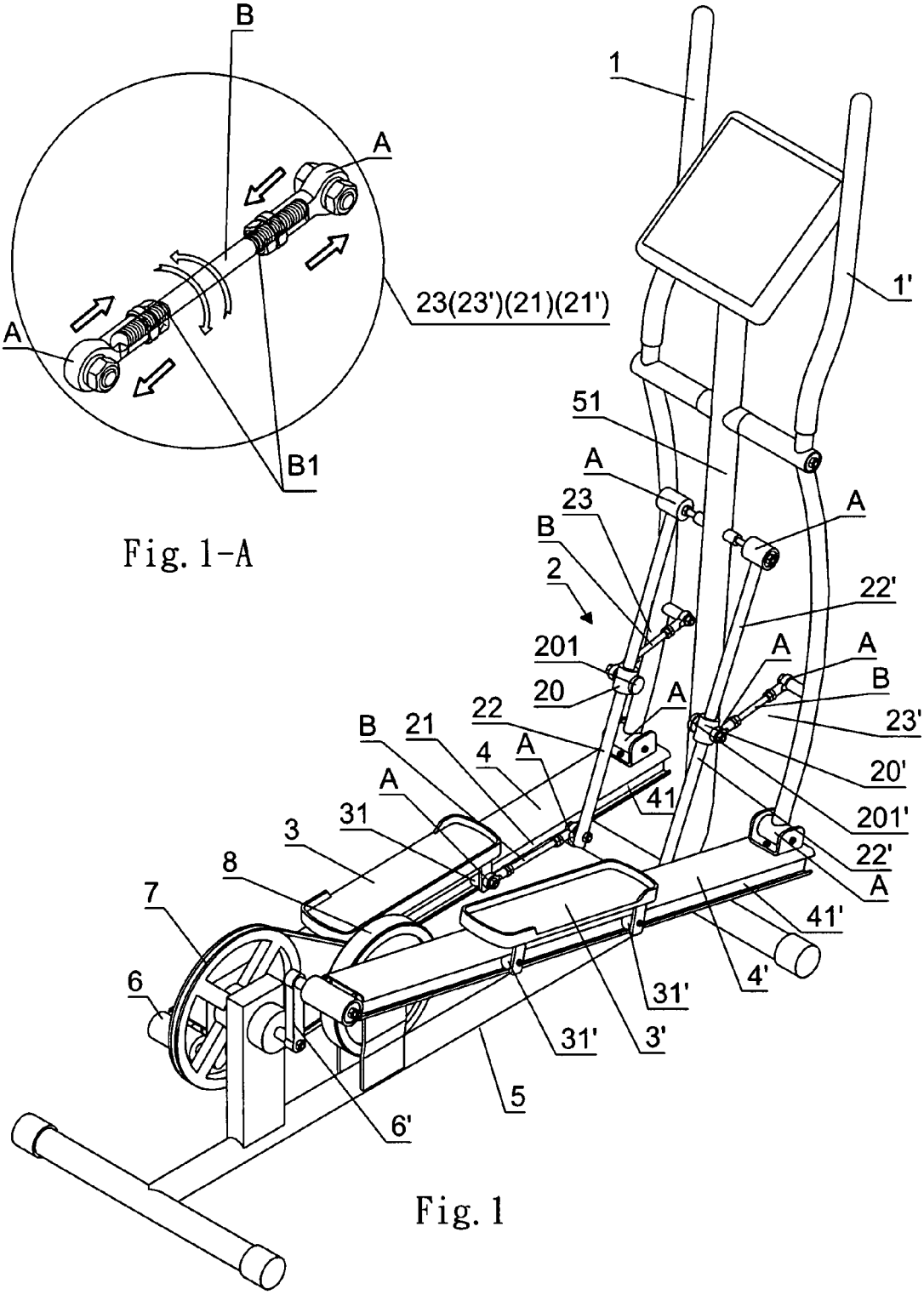
FIG. 1 is a perspective view of the present invention in a status that a user is treading on a left pedal.
Figure 2:
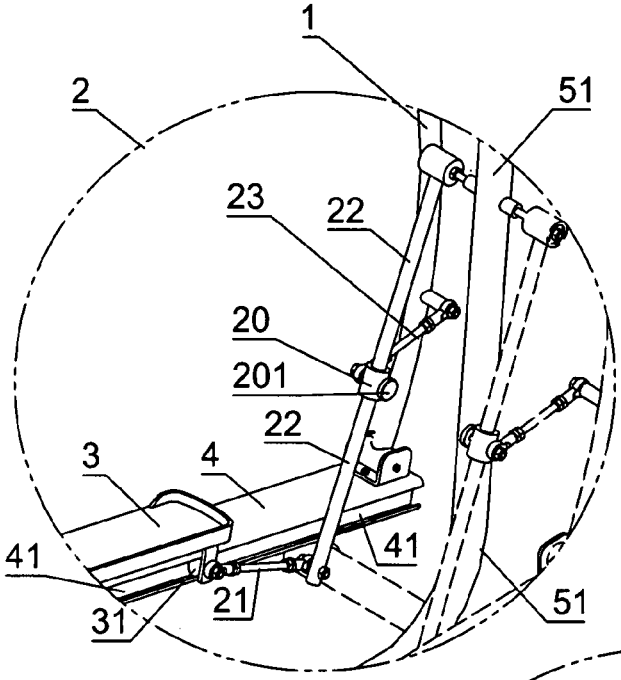
FIG. 2 is another perspective view of the first preferred embodiment of the present invention in a status that the user is treading on a right pedal.
Figure 2:
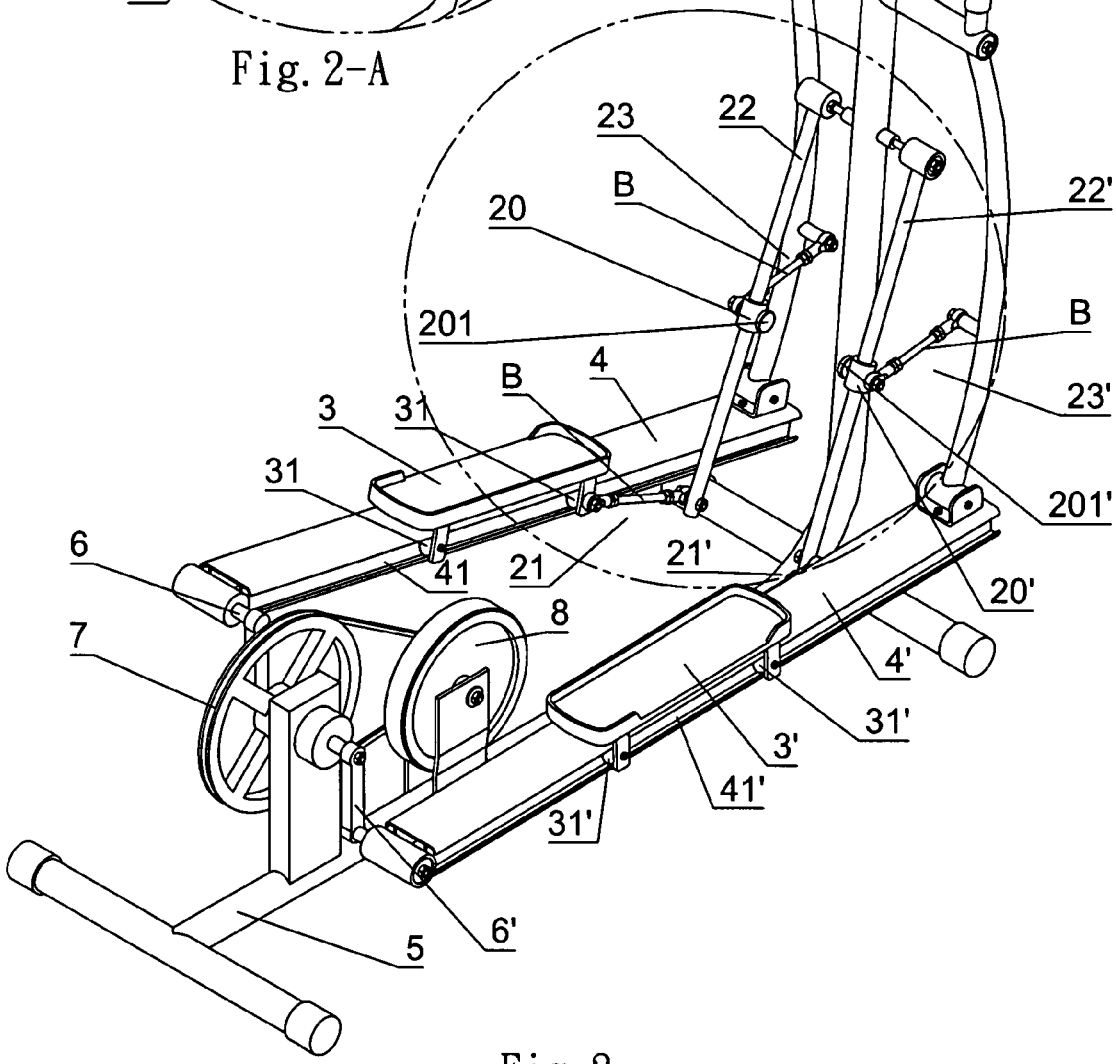

Referring to FIG. 1 through FIG. 4, an auxiliary structure for a fitness equipment of the present invention that operates on having a swing bar 1 to drive a set of connection bars 2 as illustrated in FIG. 2-A to indirectly transmit kinetic energy to a pedal 3 for a roller 31 disposed to the pedal 3 to increase its longitudinal travel range in a slide 41 disposed to a traction bar 4 to improve exercise efficacy is essentially comprised of:

A left swing bar 1 and a right swing bar 1' are respectively pivoted to both sides of a front support 51 of a base 5; a left traction bar 4 and a right traction bar 4' are respectively pivoted to lower ends of the left and the right swing bars 1, 1'; both left and right traction bars 4, 4' are respectively pivoted to a left and a right cranks 6, 6'; both of the left and the right cranks 6, 6' drive a sprocket 7 to further drive a resistance control wheel 8; accordingly, when both of the left and the right swing bars 1, 1' alternatively swing back and forth, they drive both of the left and the right traction bars 4, 4' to travel up, down, back, and forth.

Both of the left and the right traction bars 4, 4' are respectively provided with a left slide 41 and a right slide 41' for a left roller 31 and a right roller 31 attached to a left pedal 3 and a right pedal 3'.

Both of the left and the right pedals 3, 3' are respectively pivoted to a left push-and-pull connection bar 21 and a right push-and-pull connection bar 21' of the set of connection bars 2; both of the left and the right push-and-pull connection bars 21, 21' are respectively pivoted to a left transmission connection bar 22 and a right transmission connection bar 22'; both of the left and the right transmission connection bar 22, 22' are respectively pivoted to the support 51; both mid sections of the left and the right transmission connection bars 22, 22' are respectively pivoted to at where appropriately on a left active connection bar 23 and a right active connection bar 23'; and both of the left and the right active connection bars 23, 23' are respectively pivoted to where appropriately on the left and the right swing bars 1, 1'. Accordingly, when both of the left and the right swing bars 22, 22' are alternatively swinging back and forth, both active connection bars 23, 23' drive the left and the right transmission connection bars 22, 22' to drag both of the left and the right push-and-pull connection bars 21, 21', both pedals 3, 3' as dragged by both of the left and the right push-and-pull connection bars 21, 21' respectively increase their longitudinal travel range to provide a user adequate exercise amount of waist and legs so to improve exercise efficacy.

Now referring to FIGS. 2-A, 5, 6, and 7 an upper position and a lower position at where both of the left and the right transmission connection bars 22, 22' are pivoted to both of the left and the right active connection bars 23, 23' can be adjusted. To achieve the purpose, a left sleeve 20 and a right sleeve 20' are respectively inserted onto the left and the right transmission connection bars 22, 22'; and both of the left and the right sleeves 20, 20' are respectively connected to terminals of the left and the right active connection bars 23, 23'; a left bolt 201 and a right bolt 201' respectively penetrate and lock up both of the left and the right sleeves 20, 20' to respectively pack onto and secure in position on the left and the right transmission connection bars 22, 22'. Therefore, by executing displacement up and down of the left and the right sleeves 20, 20' on the left and the right transmission connection bars 22, 22' to drive both of the left and the right push-and-pull connection bars 21, 21' to further drag the left and the right pedals 3, 3' for changing their longitudinal travel ranges in providing auxiliary efficacy of twisting and treading motions as desired.

As illustrated in FIGS. 1, 5, 6, and 7, multiple pivoting elements A pivoted to both terminals of the pair of swing bars 1, 1'; active connection bars 23, 23'; transmission connection bars 22, 22'; and push-and-pull connection bars 21, 21' are related to sleeves or universal joints.

At where between two pivoting elements A respectively pivoting both of the left and the right active connection bars 23, 23' and both of the left and the right push-and-pull connection bars 21, 21' as illustrated in FIGS. 1 and 1-A is locked up with an adjusting bar B having it both terminals respectively provided with a positive thread and a negative thread B1 to allow the adjusting bar B to turn clockwise or counterclockwise. Applying both of the positive and the negative threads B1 to drive both pivoting elements A provided at both terminals of the adjusting bar B to travel inward or outward synchronously controls both of the left and the right pedals 3, 3' to change their longitudinal travel ranges as desired by the user for sliding range of both of the left and the right pedals 3, 3' in allowing adaptation to the exercise needs depending on a size of the individual user.

Figure 3:
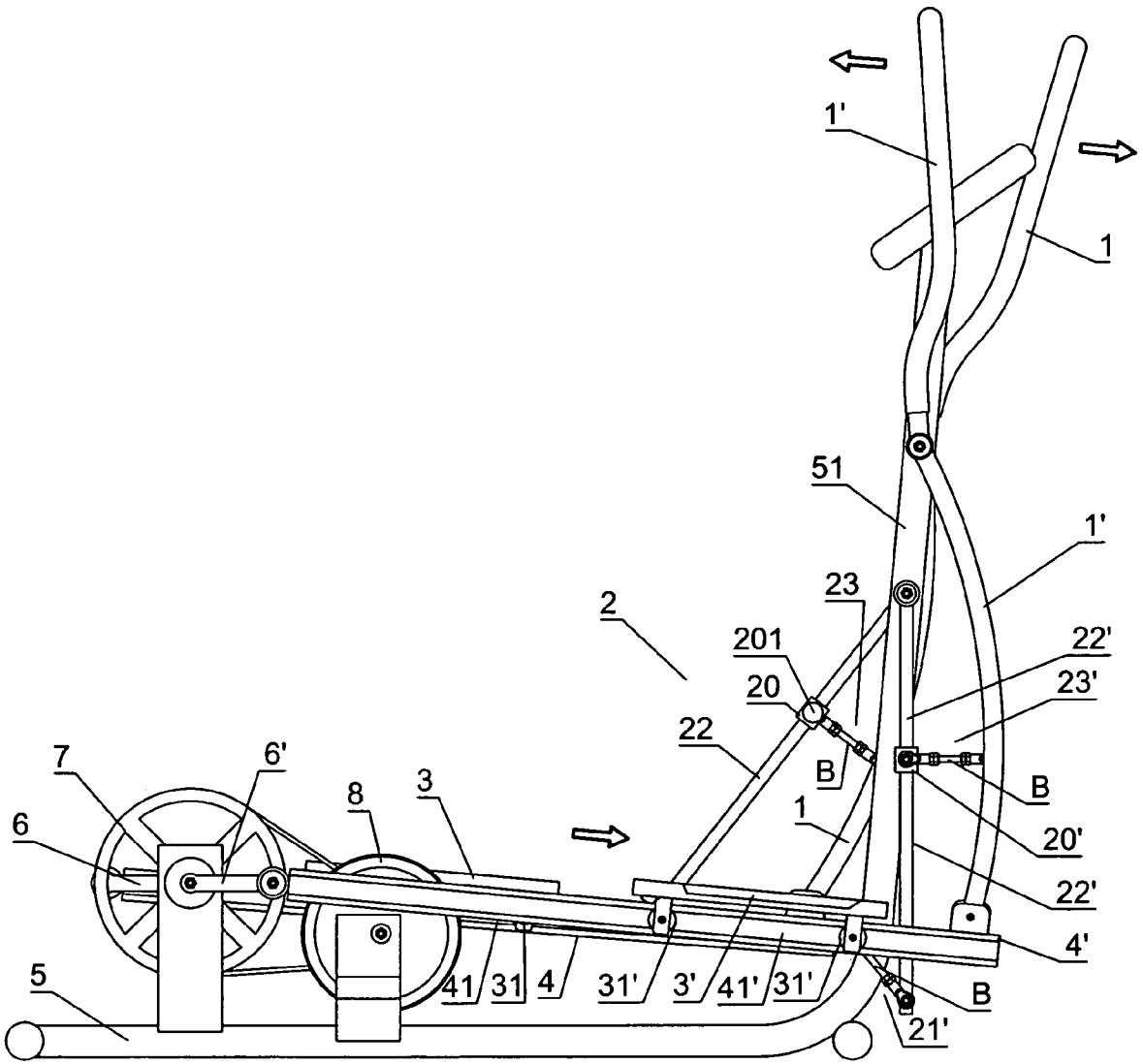
FIG. 3 is a side view of the present invention showing that a left swing bar swings forward and a right swing bar swings backward.
Figure 4:
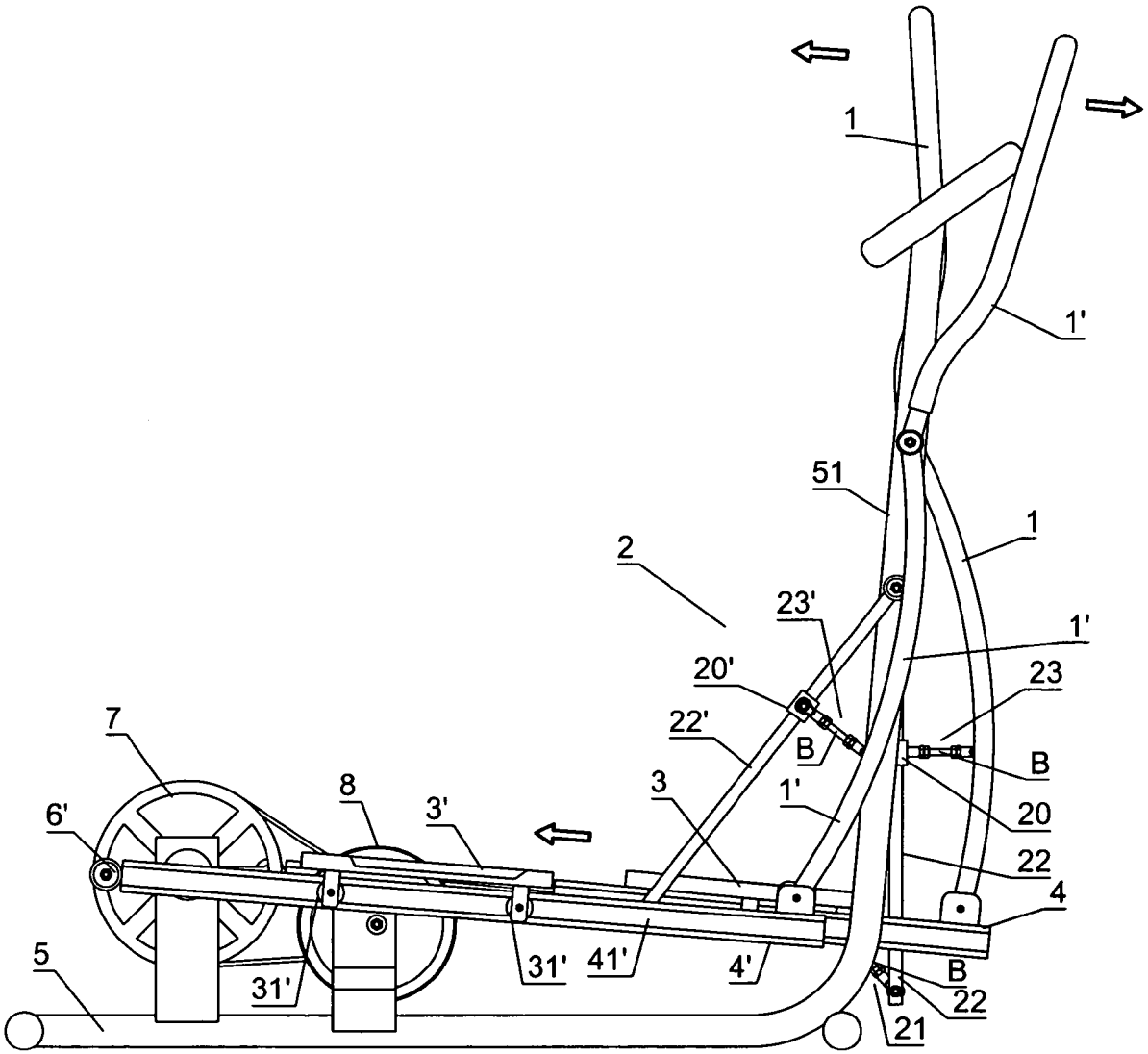
FIG. 4 is another side view of the first preferred embodiment of the present invention showing that the right swing bar swings forward and the left swing bar swings backward.
Figure 5:
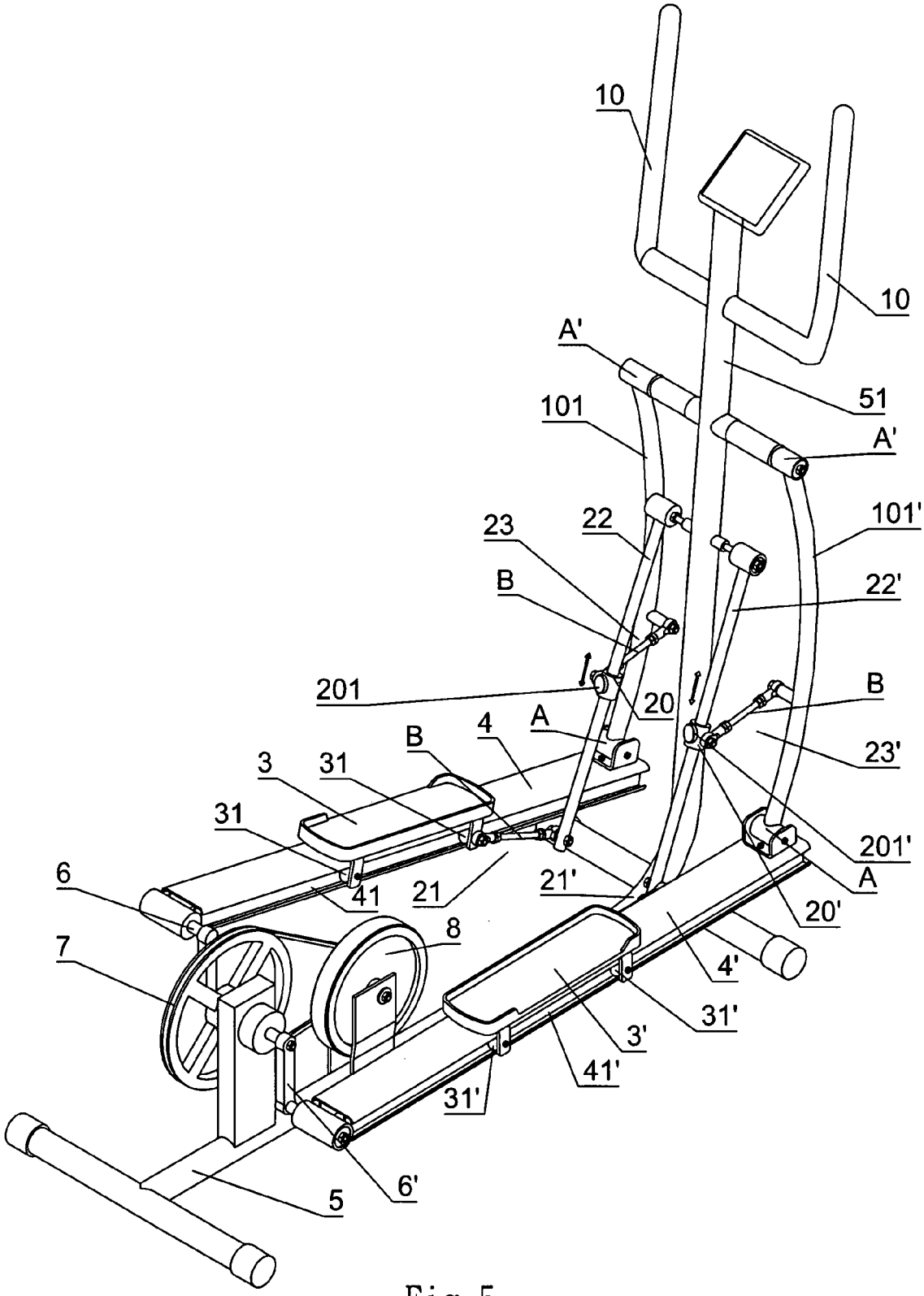
FIG. 5 is a perspective view showing another operating status of the first preferred embodiment of the present invention.

As illustrated in FIGS. 5 and 5-A in conjunction with FIGS. 1 and 3, two gripping sections 11, 11' respective of the left swing bar 1 and the right swing bar 1' are directly fixed to both sides of the front support 51 to become two handlebars 10. The user grips both handlebars 10 with both hands and steps on both pedals with both feet 3, 3' back and forth to directly dive a left swing bar 101 and a right swing bar 101' through the left and the right pivoting elements A while dragging along both left and right traction bars 4, 4' to further drive both left and right active connection bars 23, 23' and both left and right transmission connection bars 22, 22' for both left and right push-and-pull connection bars 21, 21' to drive both left and right pedals 3, 3' for both left and right rollers 31, 31 ' to increase the front and the rear displacement for the left and the right pedals 3, 3' on the left and the right slides 41, 41' through the left and the right rollers 31, 31 ' so to upgrade the stretching scope for both feet of the user.

Figure 6:
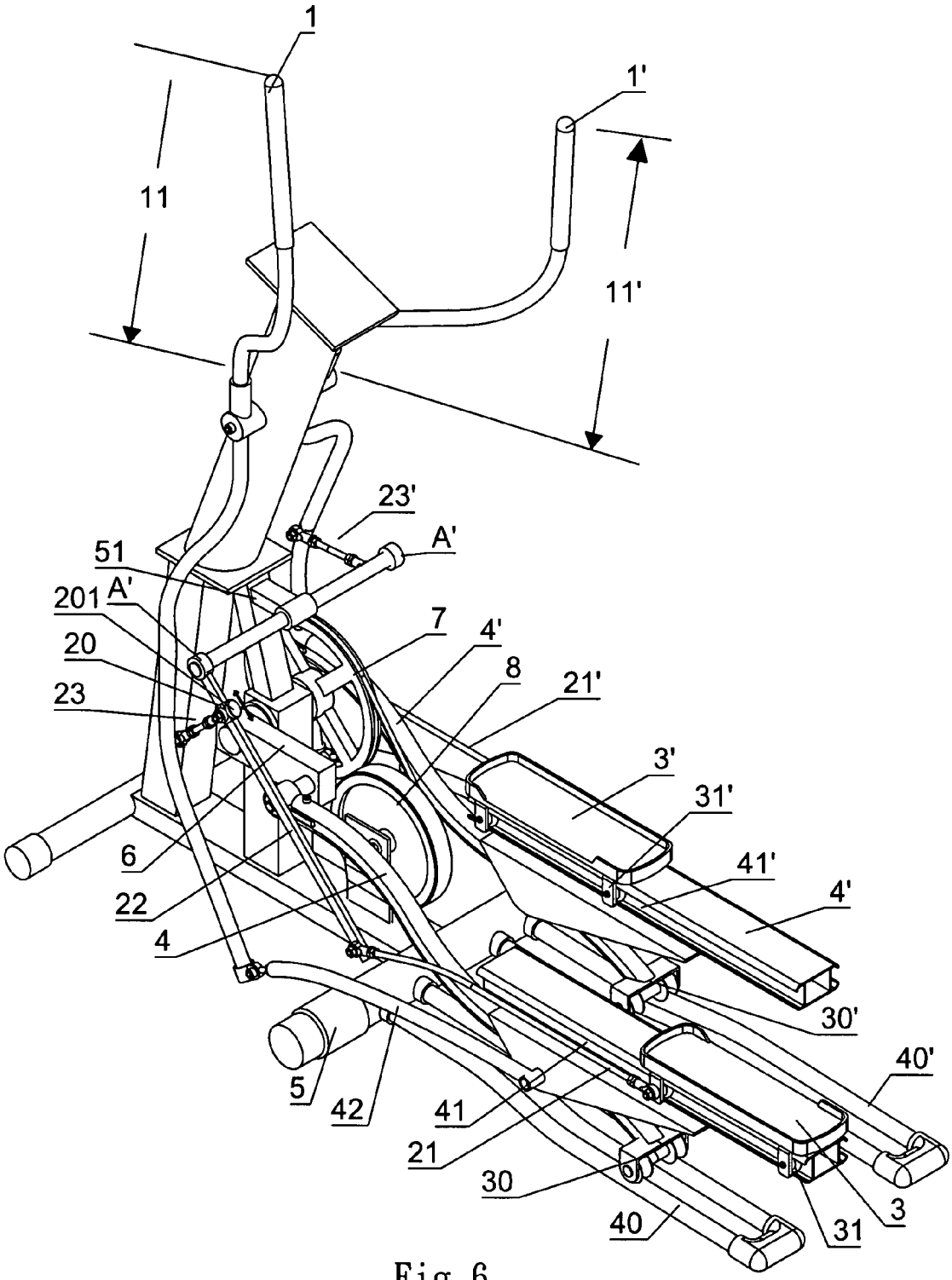
FIG. 6 is a perspective view showing a second preferred embodiment of the present invention.

As illustrated in FIGS. 6 and 6-A, the sprocket 7 and the resistance control wheel 8 illustrated in FIG. 1 are relocated to be mounted to the front support 51; front ends of the left and the right traction bars 4, 41 are respectively pivoted to the left and the right cranks 6, 6' connected to the sprocket 7; two guide wheels 30, 30' are respectively secured to where appropriately below the left and the right traction bars 4, 4' to support both left and right traction bars as they slide; and a left guide rail 40 and a right guide rail 40' are provided for the left and the right guide wheels 30, 30' to travel back and forth. With the transmission mechanism as illustrated in FIGS. 1 and 5, both sides of the front support 51 of the base 5 are respectively pivoted to the left and the right swing bars 1, 1'; both lower ends of the left and the right swing bars 1, 1' are respectively pivoted to a left secondary traction bar 42 and a right secondary traction bar 42'; and both of the left and right secondary traction bars 42, 42' are respectively pivoted to where appropriate below the left and the right traction bars 4, 4'. Meanwhile both front ends of the left and the right traction bars 4, 4' are respectively pivoted to the left and the right cranks 6, 6', both rear ends of the left and the right traction bars 4, 4' are further secured to the left and the right guide wheels 30, 30' so that when the left and the right swing bars 1, 1' are alternatively swinging, they respectively drive the left and the right secondary traction bars 42, 42' to cause the left and the right traction bars 4, 4' to travel back and forth; and the turning left and right cranks 6, 6' drive the left and the right traction bars 4, 4' to travel back and forth while swinging up and down in an oval route at the same time on the left and the right guide rails 40, 40' by following the left and the right guide wheels 30, 30'.

A left slide rail 41 and a left slide rail 41' are respectively disposed to the left and the right traction bars 4, 4' for the left and the right rollers 30, 30' of the left and the right pedals 3, 3' to travel back and forth.

The left and the right pedals 3, 3' are respectively pivoted to the left and the right pull-and-push connection rods 21, 21' of the connection rod set 2; the left and the right pull-and-push connection rods 21, 21' are respectively pivoted to the left and the right transmission connection rods 22, 22'; and the left and the right transmission connection rods 22, 22' are in turn respectively pivoted to the support 51. Both middle sections of the left and the right transmission connection rods 22, 22' are respectively pivoted at where appropriately to the left and the right active connection rods 23, 23'; and the left and the right active connection rods 23, 23' are respectively pivoted to where appropriate on the left and the right swing bars 1, 1'. Accordingly, when the left and the right swing connection rods 22, 22' are alternatively swinging back and forth, both active connection rods 23, 23' drive the left and the right transmission connection rods 22, 22' to drag the left and the right push-and-pull connection rods 21, 21 and both active connection rods 23, 23' drive the left and the right connection rods 22, 22' to drag the left and the right push-and-pull connection rods 21, 21', the left and the right pedals 3, 3' as dragged by the left and the right push-and-pull connection rods 21, 21' to increase the longitudinal traveling range of the left and the right pedals 3, 3' for providing sports amount to both legs and the waist of the user for improving body-building sports efficacy.

Figure 7:
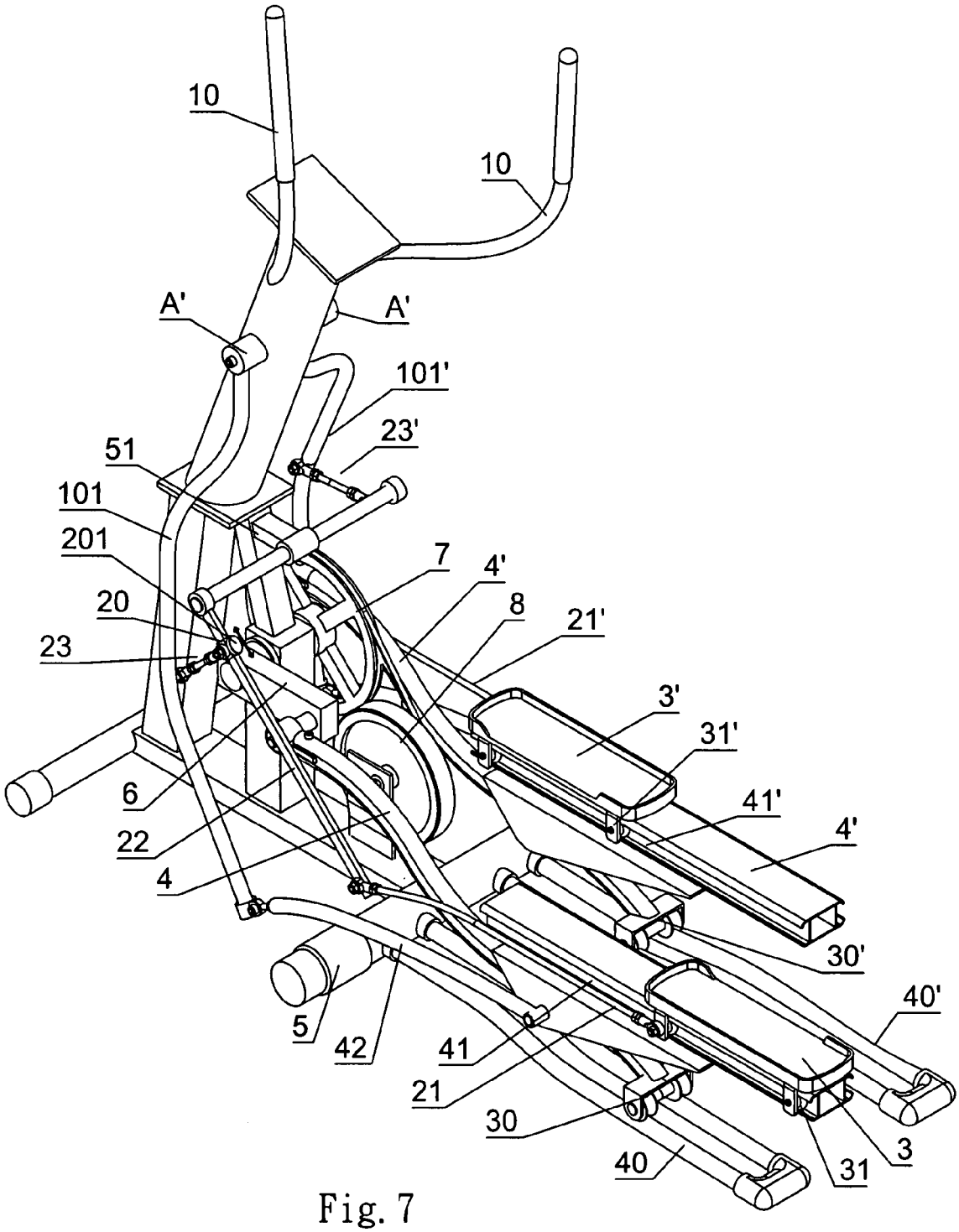
FIG. 7 is a perspective view showing another operating status of the second preferred embodiment of the present invention.

As illustrated in FIGS. 7 and 7-A in conjunction with FIGS. 6 and 6-A, both gripping sections 11, 11' of the left and the right swing bars 1, 1' are directly fixed to both sides of the support to serve as two handlebars 10*k* for the left and the right swing bars 1, 1' to directly use a left pivoting element A' and a right pivoting element A' and have both hands to grip both handlebars 10 and both feet to step on the left and the right pedals 3, 3' to move back and forth for directly driving the left and the right swing bars 101, 101' to drag the left and the right traction bars 4, 4' for further driving the left and the right active connection rods 23, 23' and the left and the right transmission connection rods 22, 22'; and in turn the left and the right pull-and-push connection rods 21, 21' drive the left and the right pedals 3, 3' to increase longitudinal placement of the left and the right pedals 3, 3' by having the left and the right rollers 30, 31' to travel on the left and the right slides 41, 41' thus to upgrade the stretch range of both feet.

I claim:

1. An auxiliary structure for improving fitness equipment efficacy comprising a left and a right traction bar each pivoted to a crank fixed by a sprocket axis from a stepper at a proper location where a sprocket and a resistance control wheel are disposed to a rear end of a base; a right and left swing bar each respectively pivoted to a front end of the left and the right traction bar; the swing bar is further pivoted to a support; a pair of pedals is disposed on the traction bars; and each traction bar when driven by the swing bar swinging back and forth drives the pedal to swing and travel up, down, back, and forth;

a set of connection bars pivoted to each swing bar and each pedal, the set of connection bars comprise left and right push-and-pull connection bars which are respectively pivoted to one end of the left and right pedal; another end each of the left and the right push-and-pull connection bars are respectively pivoted to one end each of a left and a right transmission connection bars; another end each of the left and the right push-and-pull connection bars are respectively pivoted to one end each of a left and a right transmission connection bars; another end each of the left and the right transmission connection bars are respectively connected to the support; at both middle sections of both of the left and the right transmission connection bars are respectively pivoted to respective rear ends of left and a right active connection bars; front ends of each of the left and the right active connection bars are respectively pivoted to both of the left and the right swing bars;

each traction bar disposed with a slide for the pedal to roll therein; and the pedal with a roller disposed at its bottom to roll in the slide of each traction bar;

both swing bars drive both traction bars and the set of connection bars to create individual push-and-pull results on each of both pedals to increase longitudinal travel ranges of both pedals to improve exercise efficacy of twisting and treading.

2. The auxiliary structure for improving fitness equipment efficacy as claimed in claim 1, wherein a left sleeve and a right sleeve are respectively disposed on the left and the right transmission connection bars; and both of the left and the right sleeves are respectively connected to terminals of the left and the right active connection bars; a left bolt and a right bolt respectively penetrate and lock up both of the left and the right sleeves to respectively pack onto and secure in position on the left and the right transmission connection bars; by executing displacement up and down of the left and the right sleeves on the left and the right transmission connection bars to drive both of the left and the right push-and-pull connection bars to further drag the left and the right pedals for changing their longitudinal travel ranges in providing auxiliary efficacy of twisting and treading motions as desired.

3. The auxiliary structure for improving fitness equipment efficacy as claimed in claim 1, wherein multiple pivoting elements pivoted to both terminals of the pair of swing bars; active connection bars, transmission connection bars and push-and-pull connection bars are related to sleeves or universal joints.

4. The auxiliary structure for improving fitness equipment efficacy as claimed in claim 1, wherein between the two pivoting elements respectively, which pivot the left and the right active connection bars, and both of the left and the right push-and-pull connection bars is an adjusting bar having one terminal end of the adjusting bar having a positive tread on an outer surface of the one terminal end and another terminal end of the adjusting bar having a negative thread on an outer surface of the another terminal end to allow the adjusting bar to turn clockwise or counter-clockwise, wherein rotating the adjusting bar drives both pivoting elements provided at both terminals of the adjusting bar along the positive and the negative threads to travel inward or outward to synchronously control both of the left and the right pedals to change their longitudinal travel ranges as desired by the user to allow adaptation to the exercise needs of different sizes of users.

5. The auxiliary structure for improving fitness equipment efficacy as claimed in claim 1, wherein, two gripping sections respectively of the left and the right swing bars are directly fixed to both sides of the support to serve as two handlebars; the left and the right transmission connection bars are driven for the left and the right pull-and-push connection bars to drive the left and the right pedals to increase longitudinal displacement by having the left and the right rollers to travel on the left and the right slides for upgrading a stretch range of both feet of the user.

6. The auxiliary structure for improving fitness equipment efficacy as claimed in claim 1, wherein each of those elements to respectively pivot the left and the right swing bars, both left and right active connection bars, both left and right transmission connection bars, and both left and right pull-and-push connection bars is related to a sleeve or a universal joint.

7. The auxiliary structure for improving fitness equipment efficacy as claimed in claim 1, wherein both gripping sections respectively of the left and the right swing bars are directly fixed to both sides of the support to function as two handlebars; a user grips both handles bars with both hands and steps on the left and the right pedals with both feet to step back and forth by directly applying both of the left and the right pivoting members to directly drive both left and right swing bars while dragging both of the left and the right traction bars to drive the left and the right active connection bars and the left and the right transmission connection bars for the left and the right pull-and-push connection bars to drive the left and the right pedals to increase the displacement while traveling back and forth by having the left and the right slides to travel on the left and the right slides thus to upgrade a stretch range of both feet of the user.

* * * * *